United States Patent [19]

Sexton

[11] 4,357,985

[45] Nov. 9, 1982

[54] METHOD OF ISOTHERMALLY FORMING A COPPER BASE ALLOY FIBER REINFORCED COMPOSITE

[75] Inventor: Richard W. Sexton, Grove City, Ohio

[73] Assignee: Material Concepts, Inc., Columbus, Ohio

[21] Appl. No.: 247,657

[22] Filed: Mar. 26, 1981

[51] Int. Cl.[3] ..... B22D 19/02

[52] U.S. Cl. ..... 164/61; 164/66.1; 164/97

[58] Field of Search ..... 427/305, 404, 443.1, 427/433, 405; 428/614, 634; 164/97, 100, 61, 66.1

[56] References Cited

U.S. PATENT DOCUMENTS

| | | | |
|---|---|---|---|
| 3,600,163 | 8/1971 | Badia | 164/97 |
| 3,668,748 | 6/1972 | Divecha | 164/97 |
| 3,720,257 | 3/1973 | Beutler et al. | 428/634 |
| 3,758,298 | 9/1973 | Eppich | 164/97 |
| 3,938,579 | 2/1976 | Old | 164/100 |
| 4,207,096 | 6/1980 | Sawa | 164/97 |

*Primary Examiner*—Sam Silverberg
*Attorney, Agent, or Firm*—John L. Gray

[57] ABSTRACT

The present invention comprises a process of forming a copper base alloy composite which is reinforced by graphite fibers, wherein the fibers are first coated with a continuous coating of an alloy constituent and then continuously coated with a coating of copper or a copper base alloy. The coated fibers are then heated in a vacuum under applied load, in combination with copper or a copper base alloy at a temperature above the melting point of the copper or copper base alloy but below the melting point of the alloy to be formed from the copper or copper base alloy and the alloy constituent with which said graphite fiber has first been coated.

7 Claims, 1 Drawing Figure

COPPER-NICKEL PHASE DIAGRAM

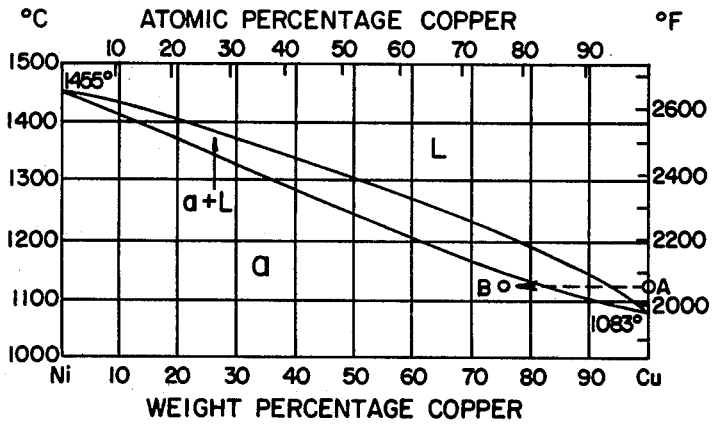
COPPER-NICKEL PHASE DIAGRAM

METHOD OF ISOTHERMALLY FORMING A COPPER BASE ALLOY FIBER REINFORCED COMPOSITE

SUMMARY OF THE INVENTION

The invention comprises a process of forming a copper base alloy graphite fiber reinforced composite. The graphite fibers are first continuously coated with an alloying constituent. A preferred alloying constituent is nickel because of its good adherence to graphite and its high melting point. After the fiber is coated with the first alloying constituent, it is then continuously coated with copper or a copper base alloy. Examples of copper base alloys which may be used are brass or bronze. The thus coated fibers may then be unidirectionally layered between sheets of copper foil or copper base alloy foil as an economical means of controlling the composition of the final product. This assembly of coated fibers plus foil is then heated to a temperature above the melting temperature of the copper or copper base alloy, but below that of the initial fiber coating (e.g., nickel). Continued treatment at this temperature causes isothermal transformation of the metallic constituents from the liquid to the solid state as a result of diffusion and homogenization. The temperature and the composition of the material are chosen such that the metallic constituents completely transform to the solid state isothermally.

Copper base alloys containing alloying elements such as iron, zinc, manganese, nickel, chromium, or tin, have been found useful for structural components in corrosion resistant applications. They are especially useful in sea water applications because they resist attachment of sea organisms, known as fouling. The shortcoming of most of these alloys of copper is their limited mechanical properties, with tensile strengths generally lower than 60,000 psi (60 KSI).

One of the best alloys with respect to corrosion resistance in a sea water environment, and one which has long life and pitting resistance, is a cupronickel alloy of from 10 to 30 percent nickel with the balance copper. However, such an alloy has tensile strength of only 60 KSI or less, a density of 8.9 g/cc, and a strength to density ratio (specific strength) of 6.7 KSI cc/g.

The strength of corrosion resistant copper-nickel alloys can be significantly increased and the density can be decreased by incorporation of graphite fibers using the method of this invention.

It is therefore an object of this invention isothermally to form a copper base alloy fiber reinforced composite.

It is a further object of this invention isothermally to form such copper base alloys containing nickel as an alloying ingredient and also containing graphite fibers.

It is another object of this invention to prepare a copper base alloy fiber reinforced composite by first coating a graphite fiber with nickel, secondly coating the fiber with a coating of copper or a copper base alloy and then isothermally heating such fiber in combination with copper or copper base alloy.

This, together with other objects and advantages of the invention, should become apparent in the details of the invention as more fully described in the drawings and specification hereinafter and as claimed herein.

BRIEF DESCRIPTION OF THE DRAWINGS

The FIGURE is a copper/nickel phase diagram.

DETAILED DESCRIPTION OF THE INVENTION

Graphite fibers are first coated with a continuous nickel coating as an initial alloying ingredient, such as by electroplating, following which they are coated with a continuous coating of copper or a copper base alloy by electroplating or some other suitable process. While nickel is the preferred initial alloying and coating ingredient, other suitable materials having high melting points and efficacy for alloying with copper may be used. The graphite fibers, thus coated, are then placed in intimate contact with copper or a copper base alloy. This can be achieved by interlaying the coated graphite fibers with copper foil or a copper base alloy foil, or by other means of providing intimate contact between the coated graphite fibers and the copper or copper base alloy such as by using copper or copper base alloy powder or by electroplating the entire volume of desired alloy matrix.

The coated fibers, in combination with the copper or copper base alloy, are then placed in a vacuum chamber and heated to a temperature above the melting point of the copper or copper base alloy but below the temperature of the initial alloying ingredient applied to the graphite fibers. Instead of using a vacuum, a hydrogen atmosphere may be used. A load is applied to the material during this period. The size of the load required depends upon the alloy and processing parameters used. For a copper-nickel alloy formed in a vacuum the size of the load may be as low as 15 psi. Sufficient load must be applied to eliminate voids and bring about complete consolidation of the article.

If copper is used as the base material and if nickel is used as the alloying constituent, the preferred heating temperature is approximately 1100° C. Above 1083° C., the copper becomes molten and fills the interstices between the fibers. At this point it is most important to maintain the composite at a temperature above 1083° C. for no more than about 15 minutes in order to prevent excessive reaction of the graphite fibers with the nickel or other alloying constituents. Example 4 illustrates this requirement. While holding the mixture at temperature, the molten copper reacts with the nickel coating on the fiber and isothermally forms a solid cupronickel alloy around the graphite fibers.

Referring to the phase diagram for copper/nickel in the FIGURE, the change from liquid to solid state is shown therein. The condition of the specimen transforms from the liquid state at point "A" to the solid state at point "B" at 1120° C. for an alloy containing 24 percent nickel.

In the general case, the relative amounts of copper or copper base alloy used are selected so that the resultant alloy, when formed after fusion of the composite, will contain a percentage of copper and a percentage of alloying constituents such that the final product is in the solid phase rather than the liquid phase at the isothermal heat treatment temperature.

The resultant composite has good strength. Tensile strengths as high as 75 KSI have been achieved and the specific strength of the copper base alloy can be increased by utilizing the method of this invention.

The following examples of fiber reinforced composites which have been prepared in accordance with the present invention, will illustrate the application of the invention. In each example, graphite fibers having tensile strength of 300,000 psi and tensile modulus of 50 million psi are used for the purpose of comparison. Other high strength fibers can, however, be used.

EXAMPLE 1

Graphite fibers known as "Thornel Type P Grade VSB-32" manufactured by the Union Carbide Corporation were electroplated with about 1.3 micrometers of nickel to produce a continuous coating thereon. Thereafter, the nickel coated graphite fibers were electroplated with about 1.2 micrometers of copper. Lengths of the plated graphite fibers were unidirectionally layered between sheets of copper foil. The amount of copper foil added was predetermined so that the resultant alloy formed after fusion of the composite contained 76 percent copper and 24 percent nickel by weight. The layered graphite specimen was placed in a vacuum chamber and heated to 1120° C. for 15 minutes during which time a load of 15 psi was applied to form a consolidated plate about 0.07 inches thick. The fiber content of the part so produced was 12 volume percent and the density was 8.1 g/cc. The tensile strength in the fiber axial direction was 56 KSI. A plate made with the same alloy constituents only without reinforcing fibers had tensile strength of 38 KSI.

EXAMPLE 2

A graphite reinforced composite was made as in Example 1 except that more coated fibers were added so that the completed part contained 22 volume percent graphite. The part was formed in a hydrogen atmosphere by heating to 1120° C. for 5 minutes with an applied load of 65 psi. The addition of more fibers further enhanced the strength of the composite, which in this case was 75 KSI, and it was also observed that this part was much stiffer than the unreinforced alloy. The density of the alloy was reduced to 7.4 g/cc by the addition of fibers, so that the specific strength was 10.1 KSI cc/g as opposed to 4.3 KSI cc/g for the unreinforced alloy.

EXAMPLE 3

A reinforced copper alloy composite was prepared in a manner similar to Example 1 except that the graphite fibers were coated with about 1.3 micrometers of nickel only. These were arranged longitudinally and heated and pressed in the manner of Example 2 with sufficient copper foil so that the graphite fiber content was 24 volume percent. The strength of this plate, however, was only 59 KSI and upon close examination it was evident that the copper alloy matrix had not fully infiltrated the fiber; thus, voids were formed which detracted from the strength of the part. This result indicated that the copper matrix plated over the first coating of nickel was beneficial to infiltration and ultimate composite strength when parts are formed by the method of Example 2.

EXAMPLE 4

Two specimens were prepared with 22 volume percent fiber as in Example 2. The first specimen was held in vacuum and a load applied at 15 psi as in Example 1 except that it was maintained at 1120° C. for more than 30 minutes; the resulting composite had tensile strength of only 37 KSI.

The second specimen was a duplication of Example 2 except that it was held at 1120° C. for about 20 minutes. The composite thus formed had a tensile strength of only 57 KSI as compared to that of Example 2 which was 75 KSI, that part having been heated at temperature for only 10 minutes.

Results of this example indicate that heating times longer than about 15 minutes are detrimental to ultimate composite tensile strength.

It will be seen from the above examples that the specific strength of a copper base alloy utilizing this method can be increased significantly. In addition, melting the matrix in situ and isothermally forming the alloy around the fibers permits the formation of curved and complex reinforced shapes which are difficult or impossible to make by other means. Furthermore, melting the copper matrix for the required short time permits full infilitration and causes less fiber damage than other means of fabrication such as pressing at high loads for long times.

While this invention has been described in its preferred embodiment, it is appreciated that variations thereon may be made without departing from the proper scope and spirit of the invention.

What is claimed is:

1. A method of forming a copper base alloy graphite fiber reinforced composite, comprising the steps of:

first coating said fiber with nickel, then coating said coated fiber with copper, heating said coated fiber in combination with a material selected from the group consisting of copper and copper base alloys to a temperature above the melting point of the material selected from the group consisting of copper and copper base alloys but below the melting point of the alloy to be formed, and holding said materials at said temperature until said alloy is formed and solidified.

2. The method of claim 1 wherein the material with which the coated fiber is heated is copper.

3. The method of claim 1 wherein the material with which the coated fiber is heated is a nickel bearing copper alloy.

4. The method of claim 1 wherein said heating of said coated fiber is carried out in a vacuum.

5. The method of claim 1 wherein said heating of said coated fiber is carried out under a hydrogen atmosphere.

6. The method of claim 1 wherein said heating of said coated fiber is conducted for about 15 minutes or less.

7. The method of claim 4 wherein said heating of said coated fiber is carried out under an applied load of a sufficient size to eliminate voids and bring about complete consolidation of said reinforced composite.

* * * * *